US007654481B2

(12) United States Patent
Huang

(10) Patent No.: US 7,654,481 B2
(45) Date of Patent: Feb. 2, 2010

(54) VARIABLE PROTECTION BOARD FOR THE PAPER SHREDDER OPENING

(75) Inventor: Simon Huang, SanChung (TW)

(73) Assignee: Michilin Prosperity Co., Ltd., Sanchung, Taipei Hsien (TW)

( * ) Notice: Subject to any disclaimer, the term of this patent is extended or adjusted under 35 U.S.C. 154(b) by 122 days.

(21) Appl. No.: 11/797,677

(22) Filed: May 7, 2007

(65) Prior Publication Data

US 2008/0128537 A1 Jun. 5, 2008

(30) Foreign Application Priority Data

Nov. 30, 2006 (TW) ..... 95221096 U

(51) Int. Cl.
*B02C 4/32* (2006.01)

(52) U.S. Cl. ..... 241/37.5; 241/100

(58) Field of Classification Search ..... 241/100, 241/236, 37.5

See application file for complete search history.

(56) References Cited

U.S. PATENT DOCUMENTS 4,564,146 A * 1/1986 Bleasdale ..... 241/236
5,167,374 A * 12/1992 Strohmeyer ..... 241/36
5,969,310 A * 10/1999 Schwelling ..... 200/61.41
6,065,696 A * 5/2000 Tsai ..... 241/37.5
6,802,465 B1 * 10/2004 Norcott et al. ..... 241/36
7,213,780 B2 * 5/2007 Chen ..... 241/100

* cited by examiner

*Primary Examiner*—Faye Francis
(74) *Attorney, Agent, or Firm*—Bacon & Thomas, PLLC

(57) ABSTRACT

This specification discloses a variable protection board that can change the width of the opening of a paper shredder. A sliding block is disposed on one side of the paper shredder opening to change the relative position between the sliding block and the opening. When the shredder is operating, the opening width thereof can be changed to a narrower default state, preventing the user from putting fingers into it and getting hurt. To back the paper out, the opening width of the shredder is changed to a wider default state for the user to take out the paper. A switch can be disposed along the stroke of the sliding block. When the sliding block goes to the state with a wider opening width for backing out paper, the shredder is powered off at the same time to shut down the running motor and thus protect the safety of the user.

10 Claims, 4 Drawing Sheets

VARIABLE PROTECTION BOARD FOR THE PAPER SHREDDER OPENING

BACKGROUND OF THE INVENTION

1. Field of Invention

The invention relates to a shredder and, in particular, to a shredder that changes its opening width to a narrower default state to prevent the user's fingers from being hurt. To back paper out, the opening width of the shredder is changed to a wider default state for the user to take out the paper.

2. Related Art

To prevent such documents as legal files, receipts, invoices, credit card numbers, research reports, or personal financial information (e.g., credit card and phone bills) from being released, it is common to destroy them using a shredder. Therefore, the shredder has become an indispensable device for both business and home applications.

The US Consumer Product Safety Commission (CPSC) issued document No. 5127 in response to paper shredder safety alert. The document reminded families with shredders to be cautious about the safety in operating the shredders. It pointed out that 31 cases of finger injuries from operating shredders have been the received reports between January 2000 and December 2003, and most of the people who got hurt were children aged from 14 months to 2 years, particularly the toddlers. This is because children at these ages like to mimic adults and play shredder without the adult's supervision. It is not guaranteed that no accident will happen even under the adult's supervision. This is because the pulling force exert by the shredder on the paper is very large. If the fingers holding the paper do not let go, the pulling force may also pull the fingers into the shredder opening and cause injuries.

Therefore, the CPSC cautioned consumers about the following things:

Do not let children to operate shredders by themselves. Even under supervision, the adult should know that there is a risk that the pulling force of the shredder may be strong enough to pull children's fingers into the shredder opening.

1. Keep shredders away from children.
2. Unplug the shredder when not in use.
3. Do not put hands or fingers on the shredder.
4. Do not operate shredders when wearing clothes with loose ends or strips to avoid being pulled into the shredder opening.
5. Keep an appropriate distance between the tie or zipper and the shredder opening.

The opening width of the usual shredder is about 6 mm. Such an opening width may be large enough for children to put in their fingers and get hurt. Some people think that such injuries can be prevented by shrinking the opening width. Nevertheless, the opening width has to satisfy the requirement of feeding and backing paper (the auto and rev functions, respectively). Therefore, in addition to feeding paper into the shredder for shredding, the design has to allow backing paper out when it is jammed. A narrow opening width would be difficult for backing out paper. Therefore, simply shrinking the width of the shredder opening cannot truly resolve the safety problem.

SUMMARY OF THE INVENTION

In view of the foregoing, an objective of the invention is to provide a paper shredder whose inlet can change to a narrowed default width when it is shredding paper, preventing user's fingers from being pulled into and getting hurt, and to a wider default width when it is backing out paper for the user to easily take it out.

Another objective of the invention is to provide a paper shredder with a switch along the moving stroke of a sliding block, so that when the shredder opening is changed to a wider width for backing paper out the shredder is powered off to shut down the operation of the motor for user's safety.

To achieve the above objective and to prevent risks in operating the product, the disclosed variable protection board has a sliding block disposed at a position by the shredder opening. By changing the position of the sliding block, the width of the shredder opening becomes narrower when the shredder is shredding paper, preventing user's fingers from being pulled into the opening. When the shredder backs paper out, the width of the opening become wider for the user to take it out. Moreover, a switch can be installed along the stroke of the sliding block. When the sliding block moves to a position for having a wider shredder opening and for backing paper out, the shredder is powered off to shut down the motor. This protects the user from injuries.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The features of the invention can be clearly understood from the following description and the accompanying drawings.

Figure 1:
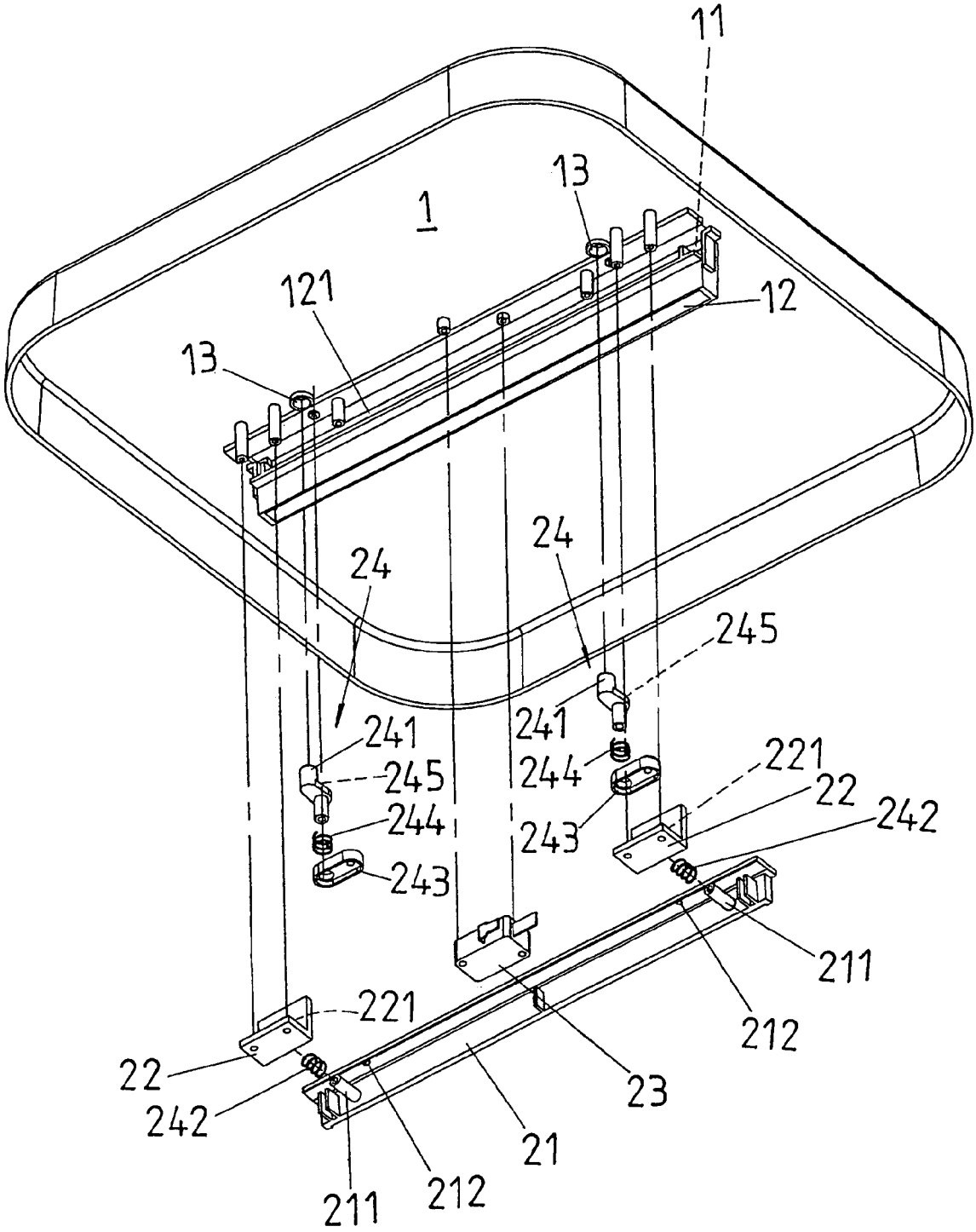
FIG. 1 shows the exploded structure of the invention.
Figure 2:
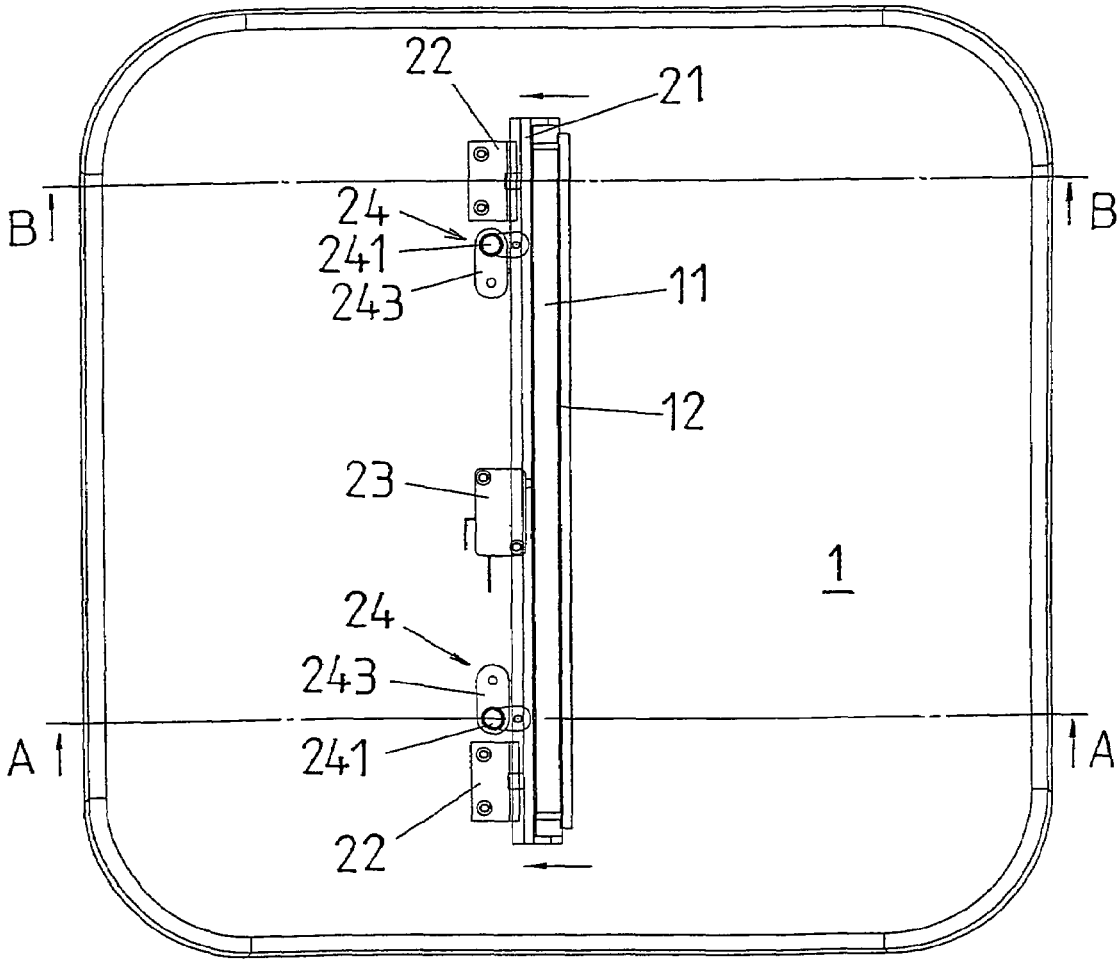
FIG. 2 shows the planar structure of the invention.

Please refer to the exploded structure shown in FIG. 1 and the planar structure shown in FIG. 2. The disclosed variable protection device is mainly a sliding block 21 disposed at the shredder opening 11. The primary action of the sliding block 21 is to vary the width of the shredder opening by changing its position. In practice, the housing 1 of the shredder is a mechanical structure installed with the relevant safety device. A guiding recession 12 extending downward is formed on the housing 1 under the shredder opening 11. The opening of the guiding recession 12 is the opening 11 of the shredder. A window 121 for accommodating the sliding block 21 is provided below the opening of the guiding recession 12. At least one limiting base 22 is provided by the window 121 for preventing the sliding block 21 from falling.

Figure 4:
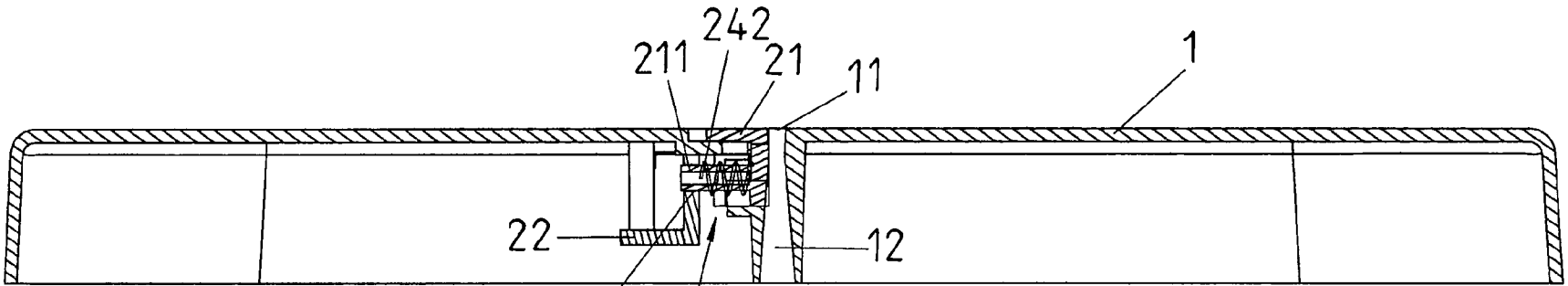
FIG. 4 shows the limiting base of the invention along the 4-4 cross-section of FIG. 2.

Please refer to FIG. 4 for the structural perspective of the limiting base of the invention. The limiting base 22 has a horizontal guiding hole 221. One side surface of the sliding block 21 is formed with a guiding pillar 211 corresponding to and extending into the guiding hole 221. Through the combination of the guiding pillar 211 and the guiding hole 221, the sliding block 21 is limited to the side of the opening 11 of the housing 1. As the width of the guiding recession 12 gets wider as it goes downward, moving the sliding block 21 along the guiding pillar 211 makes the width of the opening 11 wider or narrower.

As shown in FIG. 1, the entire safety protection device can be installed with a switch 23 along the moving stroke of the sliding block 21. In practice, the switch 23 is installed by the window 121 of the guiding recession 12 on the housing 1, at a position that can be touched by the sliding block 21. When the sliding block 21 enters the position for backing paper out (rev) so that the shredder opening has a wider width, the entire safety protection board shuts down the power of the shredder motor using the switch 23. The motor thus stops in order to protect the safety of the operator.

Figure 3:
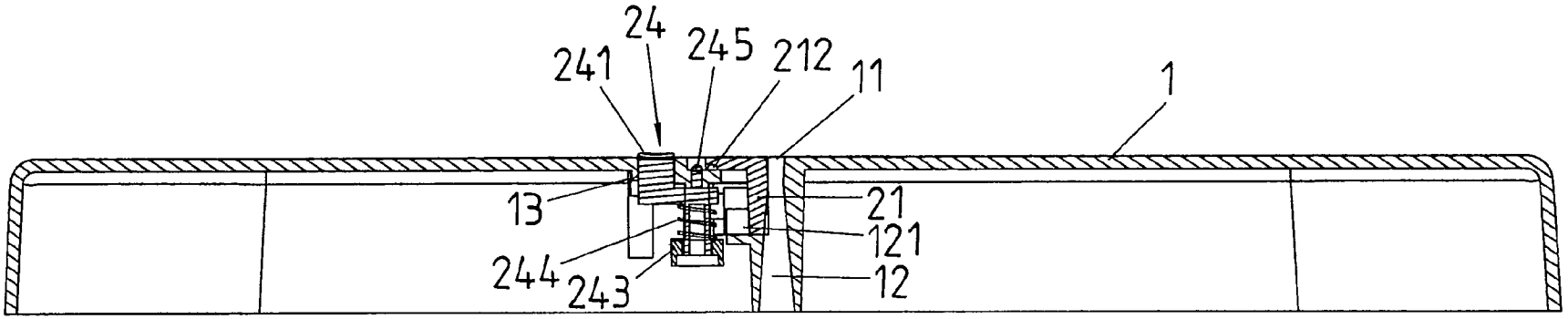
FIG. 3 shows the positioning block of the invention along the 3-3 cross-section of FIG. 2.

The disclosed safety protection device is also provided with a mechanism that retains the sliding block 21 in the positions for the auto/rev functions. As shown in FIGS. 1, 3, and 4, at least one positioning set 24 is disposed along the moving stroke of the sliding block 21 for keeping the sliding block 21 at the position for a narrower or wider opening 11. The positioning set 24 includes a positioning button 241 for keeping the sliding block 21 at the position for a wider opening 11 for the rev function, and a restoring element 242 that exerts a restoring force to push the sliding block 21 back to the position for a narrower opening 11 for the auto function.

In practice, the positioning button 241 of each positioning set 24 is provided at a position by the window 121 of the guiding recession 12 using a spring base 243. The housing 1 is formed with a button hole 13 for exposing the positioning button 241. A depressing spring 244 is provided in the spring base 243 for constantly pushing the positioning button 241 toward the top of the housing. The restoring element 242 in each positioning set 24 consists of a depressing spring disposed between the limiting base 22 and the sliding block 21. The restoring element 242 can be directly mounted on the guiding pillar 211 of the sliding block 21 to maintain the stability thereof.

Figure 5:
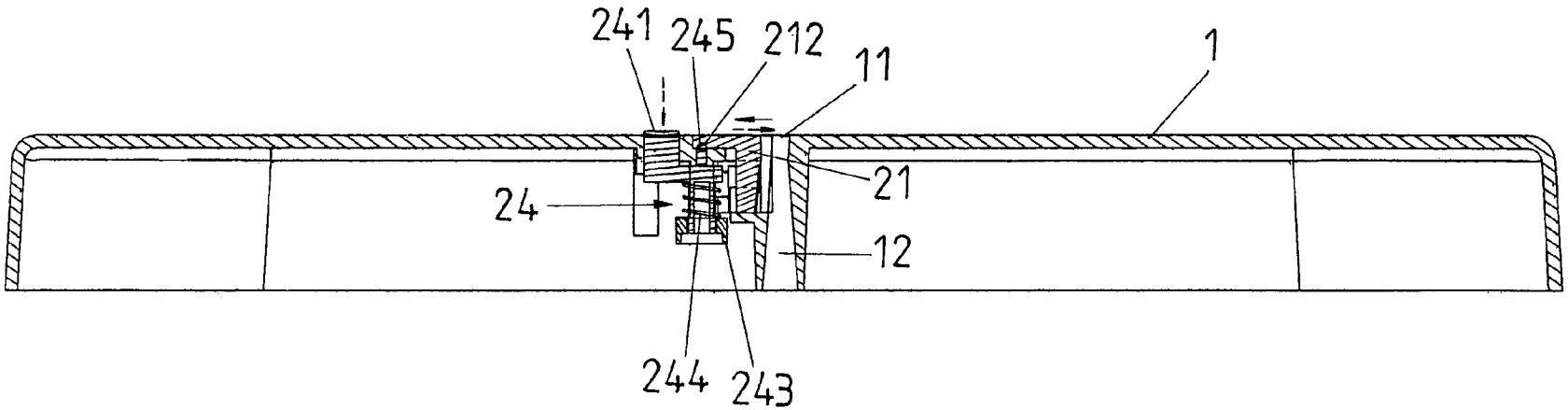
FIG. 5 is a schematic view showing how the sliding block moves according to the invention.

Moreover, the positions corresponding to the positioning button 241 and the sliding block 21 are provided with a positioning bump 245 and a positioning hole 212. As illustrated in FIG. 5, when the user pushes the sliding block 21 to the position with a wider opening 11, the positioning bump 245 falls into the positioning hole 212. With the help of the pushing force from the depressing spring 244, an effective locking action is imposed on the sliding block 21. The sliding block 21 is thus solidly fixed at the position for the rev function. The opening 11 is wider so that the operator can readily take paper out. Before this, the shredder motor is shut down by the switch. To return the sliding block 21 to the position for the auto function and a narrower opening 11, the operator only needs to press down the positioning button 241. The positioning bump 245 leaves the positioning hole 211, unlocking the sliding block 21. In this case, the sliding block 21 is pushed by the restoring element 242 back to the position for the auto function and a narrower opening 11. The invention therefore can prevent user's fingers from being pulled into the opening and getting injured.

When the shredder is shredding, the width of the opening is changed to a narrower default state. This can effectively prevent user's fingers from being pulled into the opening and getting hurt. When the shredder backs paper out, the opening is changed to a wider default state. Not only can the operator readily take the paper out, the motor of the shredder can be shut down to ensure the operation safety.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A shredder comprising:

a housing having an opening through which paper is inserted in a first direction during a paper-feeding mode and through which paper is withdrawn in a second direction opposite the first direction during a paper-backing or reverse mode;

a sliding block movably disposed by the opening of the housing to move between a first position and a second position, wherein in said first position, said block extends partially across said opening in order to narrow said opening and prevent accidental insertion of fingers through said opening during said paper-feeding mode, and wherein in said second position, said block is moved away from the first position in order to widen said opening and facilitate withdrawal of paper from said opening during said paper-backing or reverse mode.

2. The shredder of claim 1, wherein a guiding recession extends downward from the opening on the housing window for accommodating the sliding block is formed below the opening, and at least one limiting base for preventing the sliding block from falling is provided by the window.

3. The shredder of claim 2, wherein the limiting base is formed with a horizontal guiding hole and one side surface of the sliding block is formed with a guiding pillar corresponding to and extending into the guiding hole for guiding movement of the sliding block between said first and second positions.

4. The shredder of claim 2, wherein the width of the guiding recession gets wider as it goes down.

5. A shredder comprising:

a housing having an opening through which paper is inserted in a first direction during a paper-feeding mode and through which paper is withdrawn in a second direction opposite the first direction during a paper-backing or reverse mode;

a sliding block movably disposed by the opening of the housing to move between a first position and a second position, wherein in said first position, said block extends partially across said opening in order to narrow said opening and prevent accidental insertion of fingers through said opening during said paper-feeding mode, and wherein in said second position, said block is moved away from the first position in order to widen said opening and facilitate withdrawal of paper from said opening during said paper-backing or reverse mode; and at least one positioning set disposed along a moving stroke of the sliding block to keep the sliding block at the respective first and second positions until manually released by a user.

6. The shredder opening of claim 5, wherein said at least one positioning set includes:

a positioning element which fixes the sliding block at the second position for the wider opening;

a positioning button for manually pushing the sliding block into the second position, and for moving the positioning element to release the sliding block from said second position; and a restoring element, whose restoring force pushes the sliding back to the first position upon release by said positioning button.

7. The shredder of claim 6, wherein a guiding recession extends downward from the shredder opening, a window for accommodating the sliding block is formed below the opening of the guiding recession, the positioning button is installed on the housing via a spring base, the housing is formed with a button hole for exposing the positioning button, the positioning element is a positioning bump, and the spring base is provided with a depressing spring that constantly pushes the positioning button toward the top of the housing to cause said positioning bump to engage a positioning hole in said sliding block to thereby hold said sliding block in said second position.

8. The shredder opening of claim 6, wherein a guiding recession extends downward from the shredder opening, a window for accommodating the sliding block is formed below the opening, a window for accommodating the sliding block is formed below the opening of the guiding recession, at least one limiting base for preventing the sliding block from falling is disposed by the window, and the restoring element in said positioning set consists of a depressing spring disposed between the limiting base and the sliding block.

9. The shredder opening of claim 1 or 6, further comprising a switch provided in a path of the sliding block so that when the sliding block moves to the second position for the wider shredder opening, the power of the shredder motor is turned off.

10. The shredder opening of claim 1, or 6, wherein a guiding recession extends downward from the shredder opening, a window for accommodating the sliding block is formed below the opening of the guiding recession, and said switching member is disposed by the window at a position that is triggerable by the sliding block.

* * * * *